US005339718A

United States Patent [19]

Leduc

[11] Patent Number: 5,339,718

[45] Date of Patent: Aug. 23, 1994

[54] MUSICAL INSTRUMENTS HAVING BOWED OR PLUCKED STRINGS

[76] Inventor: Christophe Leduc, 2 rue Neuve, 57100 Thionville, France

[21] Appl. No.: 890,259

[22] Filed: May 29, 1992

[30] Foreign Application Priority Data

May 29, 1991 [FR] France ..... 91 06467

[51] Int. Cl.[5] ..... G10D 3/00

[52] U.S. Cl. ..... 84/291; 84/275; 84/307

[58] Field of Search ..... 84/267, 268, 269, 275, 84/277, 291, 294, 298, 307, 308, 309

[56] References Cited

U.S. PATENT DOCUMENTS

| | | | |
|---|---|---|---|
| 1,769,304 | 7/1930 | Paczkowski . | |
| 2,370,460 | 2/1945 | Patmor | 84/275 |
| 3,523,479 | 8/1970 | Ludwig | 84/275 X |
| 4,411,186 | 10/1983 | Faiure | 84/291 |
| 4,512,231 | 4/1985 | Mink | 84/277 |
| 4,607,559 | 8/1986 | Armin | 84/275 |
| 4,635,523 | 1/1987 | Merchant | 84/307 |

FOREIGN PATENT DOCUMENTS

| | | |
|---|---|---|
| 0056537 | 7/1982 | European Pat. Off. . |
| 271064 | 3/1913 | Fed. Rep. of Germany . |
| 489353 | 1/1919 | France . |

*Primary Examiner*—Michael L. Gellner
*Assistant Examiner*—P. Stanzione
*Attorney, Agent, or Firm*—Bacon & Thomas

[57] ABSTRACT

A musical instrument having plucked strings includes a sound board resting freely on the body of the instrument and which is put into vibration in a plane normal to its surface by a bridge of asymmetrical structure that supports the strings of the instruments and that rests on said sound board. The sound board is clamped at a projecting one of its ends between the body and the tailpiece of the instrument, and at its other end it rests on supports secured to the body. The bridge is supported at its treble string end directly by means of a fixed finger secured to the rigid body, and at its bass string end by the freely mounted sound board to which pressure and vibration are transmitted by a thrust piece which defines an asymmetrical configuration relative to the fixed finger.

16 Claims, 2 Drawing Sheets

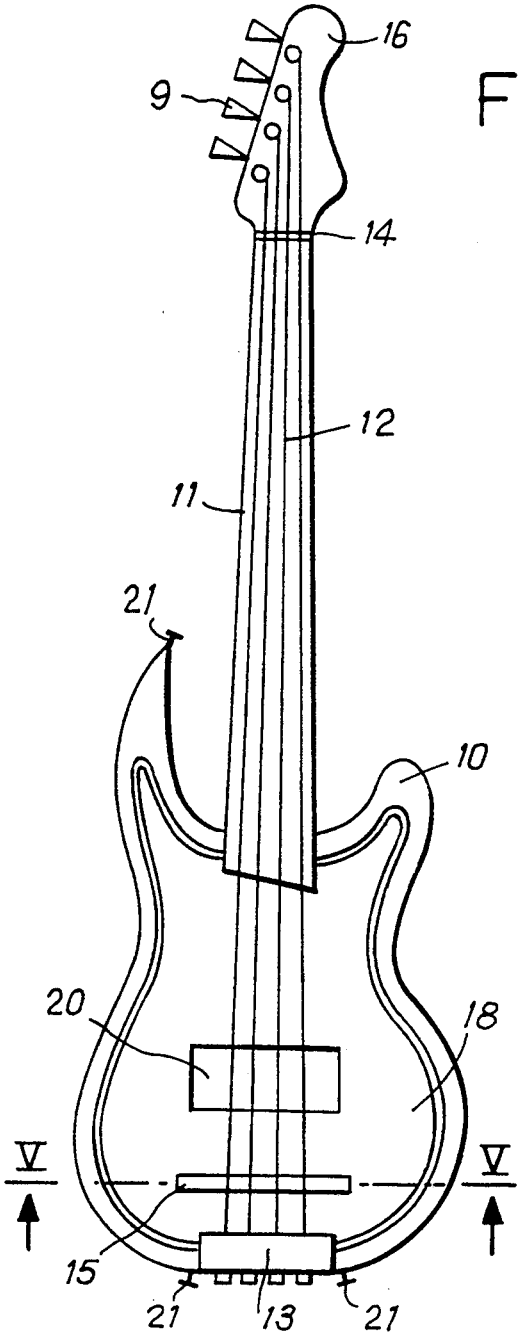
FIG. 1
FIG. 2
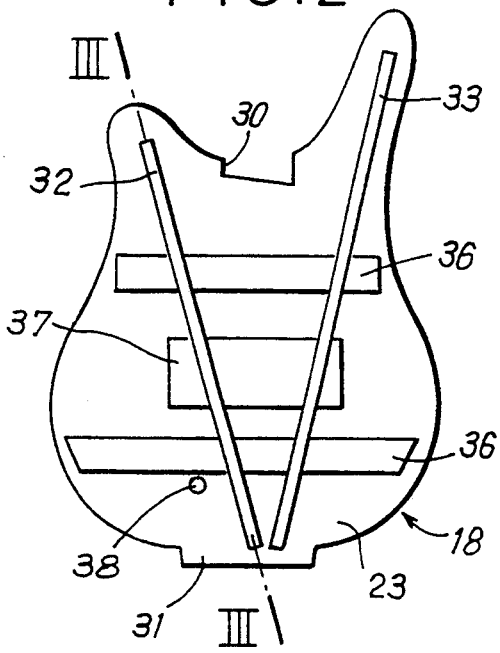
FIG. 6
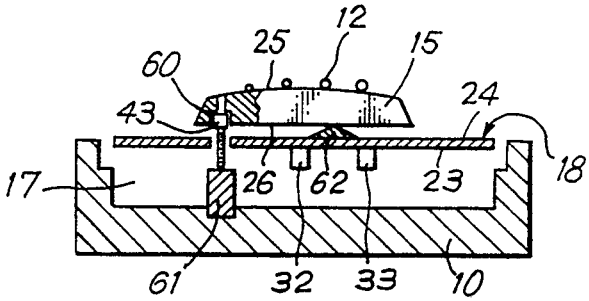
FIG. 3
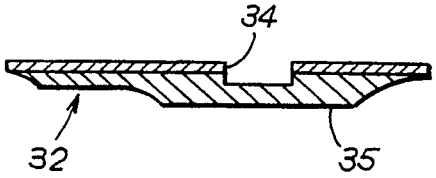

MUSICAL INSTRUMENTS HAVING BOWED OR PLUCKED STRINGS

BACKGROUND OF THE INVENTION

1. Field of the Invention

The present invention relates to musical instruments having bowed or plucked strings such as acoustic guitars or electric guitars and more particularly electric bass guitars.

2. Discussion of the Prior Art

Since the appearance of the first acoustic electric guitars which were no more than conventional acoustic guitars provided with a device for picking up and amplifying the sounds produced by the instrument, considerable progress has been made in this field with solid body guitars and then half-solid thin-body guitars being created.

The solid body guitars or "solid box" guitars comprise a body made of solid wood and a solid neck.

Some, known as "stick" guitars, comprise the neck only. Not having a sound box, such guitars have no acoustic quality, and the sounds they produce are practically pure, not including the harmonic richness that gives rise to the timbre specific to each instrument.

The search for better acoustic quality then led to half-solid thin body guitars being created, also referred to as "semi hollow-body" guitars, and like conventional guitars they also possess a sound box. It is small in size to avoid the severe problems created by the howl-around that used to exist with the first electro-acoustic guitars, while allowing performance over a wider range than solid box guitars.

However, it turns out that the additional harmonic characteristics provided by said half-box structure are not suitable for certain instruments, and in particular for an electric bass guitar where the looked-for sounds are close to those of the double bass.

Patent document EP-A-0 056 537 proposes improving the harmonic content of stringed instruments having a rigid body by fitting them with a sound board that bends under pressure from a tailpiece which is subjected to the tension in the strings and thus exerts longitudinal thrust on the board.

However, the thrust exerted by the tailpiece on the sound board causes it to buckle, thereby considerably limiting the intensity of the vibrations that it can produce.

In addition, the structure used in stringed instruments of the bowed type has an external appearance reminescent of traditional acoustic instruments, with the narrow F-holes of a conventional instrument nevertheless being replaced by a huge opening, which is a completely unacceptable handicap for electrical instruments.

SUMMARY OF THE INVENTION

The present invention proposes remedying the above drawbacks by providing a novel architecture for stringed musical instruments.

This object is achieved by an instrument provided with a sound board resting floatingly on the body of the instrument and which is caused to vibrate in a plane normal to its surface by a bridge of asymmetrical structure resting on said sound board and serving to voice the vibration of the strings which it serves to support.

Advantageously, the sound board is clamped at one of its ends that projects between the body and the tailpiece of the instrument and at its other end it rests on supports secured to said body. However, it may rest at both ends on supports secured to said body, or it may be clamped at both ends, with its sides being left floating.

Similarly, the inside face of said sound board includes a first tone bar disposed on the bass string side, and a second tone bar extending on the treble string side. However, it may include only one tone bar disposed on the bass string side and intended mainly for preventing deformation of the board. To reinforce the said board, it may also include support bars disposed transversely on its inside face.

Advantageously, the tone bar includes both a recess for receiving the pickups of the instrument and also reinforcement for mitigating the structural weakening created by the recess.

In a first embodiment, the bridge includes a convex top portion on which the strings of the instrument rest and an asymmetrical bottom portion having three legs, the first disposed on the treble string side resting on the body via a through finger passing through a hole provided in the sound board for this purpose, and the second and third legs disposed on the bass string side forming an arch standing on the outside face of said sound board, each of said second and third legs being capable of co-operating with a respective one of the ends of the tone bars situated on the inside face of said sound board. The said first leg may also stand directly on said sound board.

In a second embodiment, the bridge has a convex top portion receiving the strings and a bottom portion including a spot-faced hole at its treble string end which receives a finger which is secured to the body and which is adjustable in height, the other end of the bridge, at its bass string end, resting on the sound board via a block glued to said sound board or merely clamped by the bridge.

BRIEF DESCRIPTION OF THE DRAWINGS

Other aspects and advantages appear more clearly from the following description made with reference to the drawings, in which:

FIG. 1 is a plan view of an electric bass guitar provided with a freely mounted sound board of the invention;

FIG. 2 is a plan view of the freely mounted sound board on its own;

FIG. 3 is a longitudinal section through a tone bar on plane II—II of FIG. 2;

FIG. 6 is a cross-section view on plane I—I of FIG. 1 in which the legs of the bridge have been replaced by a moving block.

DETAILED DESCRIPTION OF THE PREFERRED EMBODIMENTS

Figure 4:
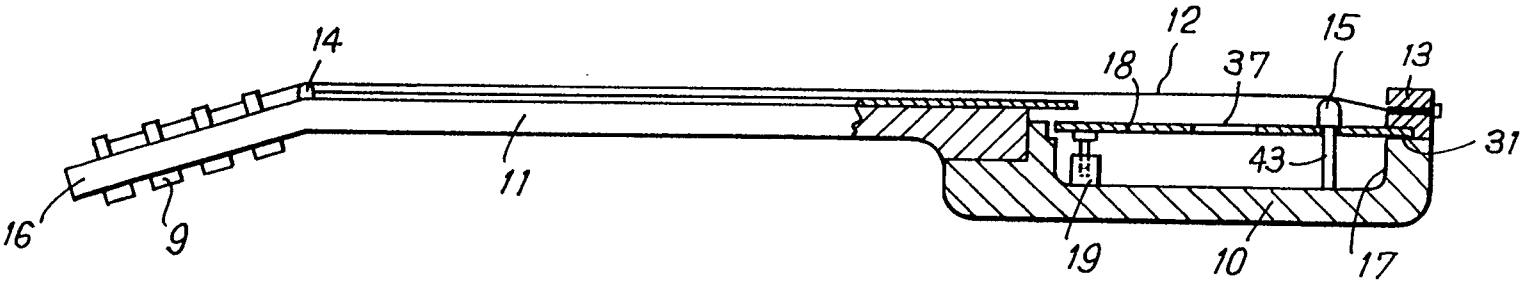
FIG. 4 is a longitudinal section view through the instrument of FIG. 1.

Reference is made initially to FIG. 1 which is a plan view of an electric bass guitar provided with a freely mounted sound board of the invention.

By way of illustration, a preferred embodiment of an electric bass guitar is shown having four strings, but it will easily be understood that the invention is equally applicable to a bass guitar having five or six strings, with or without a peg head, or merely a conventional type of electric guitar.

The stringed instrument of FIG. 1 comprises, like any solid box guitar, a body 10 and a solid neck 11 engaged in said body 10.

Strings 12 going from one end to the other of the instrument are tensioned between a tailpiece 13 secured to the body 10 and pegs 9 (cf. FIG. 4) secured to a peg head 16 of the neck 11. A nut 14 fixed to the base of the head 16 and a bridge 15 resting on or fixed near to the tailpiece 13 determine the selected vibration lengths of the strings by the distance between them.

The body 10 is made of a solid material, advantageously wood that is dense and compact, however composite materials or more exotic materials such as metal or plastic would be perfectly suitable. An opening 17 is formed therein. This opening 17 is covered by a sound board 18 which rests simultaneously on supports 19 (cf. FIG. 4) and on the body 10.

Electromagnetic pickups 20 are disposed beneath the strings 12 in the gap between the bridge 15 and the bottom end of the neck 11. The electronics for processing the sound picked up by said pickups 20 (not shown in FIG. 1) is of conventional type, having an outlet jack advantageously placed at the back of the instrument so as to avoid getting in the way of a player whether sitting or standing. Sound may also be picked up by any other system, in particular using piezoelectric pickups.

Fasteners 21 for passing a sling are disposed in such a manner as to allow the instrumentalist to use the instrument either in a horizontal position like a guitar or in a vertical position like a double bass.

The sound board 18 which is shown in greater detail in FIG. 2 may be made of materials as various as those that can be used for the body, and there is no need to harmonize these two elements. Thus, it is quite possible to make an instrument having a body of solid wood such as maple, ash, or mahogany, and a sound board made of composite materials.

The shape of the sound board 18 is not important but as far as possible it should match that of the body 10 of the instrument which may itself vary with market taste. However, there is nothing to prevent the board being different in shape from the body of the instrument.

One of the ends of the sound board 18 includes a notch 30 arranged to receive the bottom end of the neck 11, and its other end has a projection 31 enabling the board to be held clamped between the body 10 and the tailpiece 13.

At the back of the sound board 18, on its inside face 23, two tone bars 32 and 33 are fixed, one disposed on the bass string side of the instrument and the other going towards the treble string side.

FIG. 3 shows more clearly the shape of the tone bar 32 associated with the treble strings. A recess 34 may be formed in said bar 32 to allow a conventional pickup 20 of usual dimensions to be passed therethrough, and the tone bar may correspondingly also have reinforcement 35 to ensure that the assembly is sufficiently rigid and to prevent the board deforming. The same applies to the bar 33. Nevertheless, it is possible and desirable by an appropriate disposition of the pickup 20 to have recourse to these two operations of forming a recess and of providing reinforcement for only one of the two tone bars 32 and 33, or even to avoid modifying either of them by using thinner pickups. The tone bars are dimensioned to resonate at the same frequency or possibly at two different frequencies that are separated by a simple interval such as a fifth, for example. Nevertheless, using a board that is thicker and thus heavier in order to seek lower frequencies may allow one or even both of the tone bars to be omitted, in which case the board on its own performs the role previously performed by the bars.

We return to FIG. 2. In order to ensure good dimensional behavior of the sound board 18, transverse support bars 36, e.g. two such bars as shown in FIG. 2, are also fixed to the back of said board 18, on its inside face 23 in which an orifice 37 is formed to pass the pickups 40. Finally, a hole 38 is drilled close to the end of the sound board 18 having the projection 31, to pass a finger supporting one of the legs of the bridge 15 which is described in greater detail below with reference to FIG. 5.

FIG. 4 is a longitudinal section through the above-described instrument and in order to simplify the drawing, any elements that may be fixed to the back of the sound board have been omitted. The other elements are given the same references as defined above. There can also be seen one of the two supports 19 which may be adjustable in height and which serve to support one of the ends of the board, together with the finger 43 for supporting one of the sides of the bridge. Advantageously, the supports 19 are disposed at the opposite end from the projection 31, at the ends of the tone bars 32 and 33. The board is thus clamped at one of its ends and rests on two supports 19 at its other end, while its sides remain completely free to allow it to vibrate as simply as possible. When the board does not have tone bars, it includes a finer end which is then clamped at the tailpiece 13.

Figure 5:
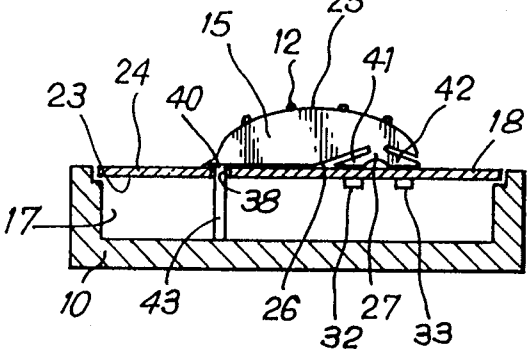
FIG. 5 is a cross-section view on plane I—I of FIG. 1 showing the special structure of the bridge.

FIG. 5 is a cross-section through the instrument of FIG. 1 in which the bridge 15 which supports the strings 12 over its convex top portion 25 has a bottom portion 26 which is completely asymmetrical in configuration, having three legs 40, 41, and 42. The first leg disposed at the treble string side rests on the body 10 which is made accessible via the hole 38 formed specially through the sound board 18, and by means of a finger 43. The second leg 41 and the third leg 42 disposed on the bass string side together form an arch 27 bearing against the outside face 24 of the sound board 18 to drive the two tone bars 32 and 33 disposed on the back of the board 18 on its inside face 23 immediately beneath each leg. When the board does not have tone bars, the drive takes place through two distinct zones of the board immediately beneath each of the feet.

FIG. 6 is a cross-section through the instrument of FIG. 1 in which the second and third legs 41 and 42 are replaced by a block 62. This support piece is distinct from the bridge 15 and may be fixed, e.g. by gluing, to the sound board 18 or it may merely be freely clamped by the bridge 15. In which case, the easy lateral displacement of the block 62 relative to the bridge makes it pointless to form an arch 27 between the legs 41 and 42 for contributing to a good distribution of pressure. The treble string side of the bridge 15 includes a step-face hole 60 which receives the finger 43 fixed directly on the body, and which may be adjustable in height.

The operation of this instrument of the invention is now described. In a solid box instrument, since the box has considerable energy, it does not respond or it responds very little to the vibrations of the string which then produces a sound that is relatively pure and of long duration. In contrast, in an acoustic instrument, the strings transmit a certain amount of energy to the sound board, thereby causing it to vibrate, with vibration being transmitted from the strings to the board via a bridge.

In stringed instruments of the invention, the sound board which is freely mounted is no longer a structural element of the instrument but is merely a plate subjected to pressure exerted normally to a bridge. By having one of its legs standing on the body of the instrument, the bridge ensures that the treble strings sound similar to those of solid box instruments with vibration lasting a considerable length of time, known as "sustain". In contrast, for lower pitched sounds, the special disposition of the bridge and its tone bars makes it possible to communicate vibration to the largest possible area of the board and thus to obtain maximum voicing for these frequencies whose influence is thus enhanced relative to that of the treble strings. This is also true when the board does not have tone bars, with the stiffness of the board then making such greater communication of vibration possible.

The resonant frequency of the board depends not only on its material and on its dimensions, but also on the various elements such as the tone bars or the supports that may be fixed thereto, all of which elements are easily modified.

The board itself may equally well be fixed at both ends, be fixed at one end and merely supported at the other end as in the preferred embodiment as described, or it may merely be supported at both ends, with the particular method of fixing chosen depending on the desired resonant frequency. Such simple fixing makes it possible to interchange boards particularly easily after the bridge has been removed and the strings slackened, merely by extracting the board in place, regardless of whether the board is merely supported or is clamped at one of its ends by the tailpiece.

Because of the extreme mobility of the sound board, the dynamic range of an instrument provided with such a board is very great. In a traditional electric instrument, and in particular a solid box type electric bass guitar (it has already been mentioned that the semi hollow-body structure is used only rarely for such instruments), because of the proximity of the finger board and the box, the instrumentalist is limited by the amplitude of the vibration that the string can achieve after being bowed or plucked, whereas in an instrument provided with a freely mounted sound board, because of the damping created by said sound board, particularly for the bass strings, it becomes possible to play fortissimo without encountering the disagreeable sounds that exist in conventional instruments.

The extreme mobility of the sound board also has an effect on the evaluation of the intensity of vibration. In a solid box type instrument, after a very intense attack, the intensity decreases progressively and disappears after a few seconds.

In contrast, in the stringed instrument of the invention, a short time after the attack, an increase in the intensity of vibration occurs because of the vibrational energy stored by the board being restored, thereby causing the instrument to have a particular sound, namely the smooth timbre of the traditional double bass.

In addition, because of the asymmetry of the bridge, the bass strings are treated oppositely from the treble strings. Relative to the fixed finger, the bass strings have a much greater lever arm than the treble strings, thereby enhancing communication of bass string vibrations to the sound board.

Figure 7:
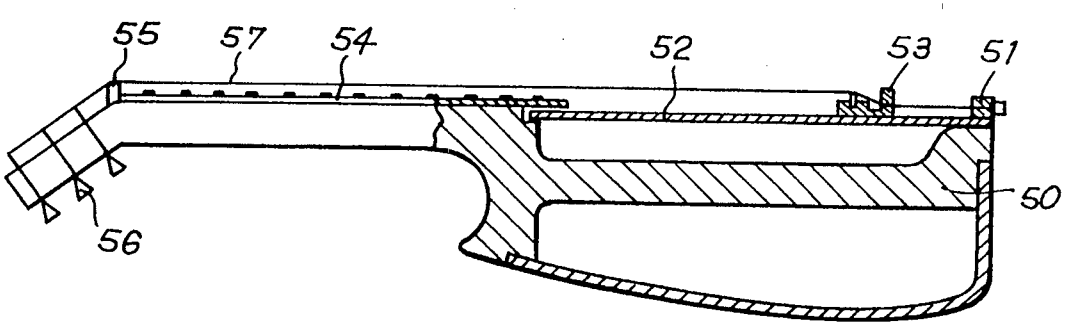
FIG. 7 is a longitudinal section view through an acoustic guitar provided with a freely mounted sound board of the invention.

FIG. 7 shows another embodiment of the invention as applied to an acoustic guitar. In this case, it is possible to dissociate the mechanical stability of the instrument which may be provided, for example, by an extension of the neck 50 towards the tailpiece 51 from the sound-producing work of the board. The sound board 52 is clamped at one of its ends between the neck 50 as extended in this way and the tailpiece 51, and its other end is merely placed on the neck 50 which no longer performs a structural function but acts only in establishing the sound of the instrument.

Like a conventional acoustic instrument, there is a bridge 53, a finger board 54, a nut 55, and pegs 56 for tensioning the strings 57. Similarly, the bridge 53 may merely rest on the board 52 without it being necessary to connect it to the body by a finger, and the space left beneath said sound board 52 then acts as a resonant box for different vibrations of the string.

This other embodiment clearly shows the very wide range of application of this musical instrument of the invention provided with a freely mounted sound board.

Given its multiple shapes and ease of manufacture, the invention can be adapted to all types of electric or acoustic stringed instruments without changing the external appearance thereof, with the gap that exists between the body of the instrument and the sound board constituting a more attractive margin than is to be found in conventional instruments, where such a margin is provided for decorative reasons only.

I claim:

1. A musical instrument having plucked strings, the instrument including a sound board resting freely on the body of the instrument and which is caused to vibrate in a plane normal to its surface by an asymmetrical bridge resting on said sound board, said bridge having a top portion, which receives said strings and defines a treble string end and a bass string end, and a bottom portion, said bridge being supported at its treble string end directly by means of a finger secured to said body and its bass string end by said sound board to which pressure and vibration are transmitted through a support piece, said bottom portion having a hole at said treble string end in which said finger is received, while the bass string end of said bridge rests on the sound board by means of a block positioned between said sound board and said bridge, said block being adjustable along said bridge.

2. A musical instrument having plucked strings according to claim 1, in which said sound board is clamped at a projecting one of its ends between the body and the tailpiece of the instrument and rests at its other end on supports secured to said body.

3. A musical instrument having plucked strings according to claim 1, in which said sound board rests at each of its ends on supports secured to said body.

4. A musical instrument having plucked strings according to claim 1, in which said sound board is clamped at each of its ends, while its sides are left free.

5. A musical instrument having plucked strings according to claim 1, in which said sound board includes at least one longitudinal tone bar on its inside face for preventing said board from deforming.

6. A musical instrument having plucked strings according to claim 5, provided with pickups, wherein said tone bar includes a recess through which the pickups of the instrument pass, in conjunction with reinforcement for mitigating the structural weakening caused by said recess.

7. A musical instrument having plucked strings according to claim 1, wherein the top portion of said bridge is convex.

8. A musical instrument having plucked strings according to claim 1, wherein the hole formed in the bottom portion of said bridge includes a stepped face.

9. A musical instrument having plucked strings according to claim 1, further including means for adjusting the height of said finger.

10. A musical instrument having plucked strings, the instrument including a sound board resting freely on the body of the instrument and which is caused to vibrate in a plane normal to its surface by an asymmetrical bridge resting on said sound board, said bridge having a top portion, which receives said strings and defines a treble string end and a bass string end, and a bottom portion, said bridge being supported at its treble string end directly by means of a finger secured to said body and its bass string end by said sound board to which pressure and vibration are transmitted through a support piece, said bottom portion including three legs, the first leg at the treble string end receiving said finger, while the second and third legs disposed at the bass string end form an arch standing on an outside face of said sound board, each of said second and third legs being capable of cooperating with a respective one of the ends of at least one tone bar situated on an inside face of said sound board.

11. A musical instrument having plucked strings according to claim 10, in which said first leg stands directly on said sound board.

12. A musical instrument having plucked strings according to claim 10, in which said sound board is clamped at a projecting one of its ends between the body and the tailpiece of the instrument and rests at its other end on supports secured to said body.

13. A musical instrument having plucked strings according to claim 10, in which said sound board rests at each of its ends on supports secured to said body.

14. A musical instrument having plucked strings according to claim 10, in which said sound board is clamped at each of its ends, while its sides are left free.

15. A musical instrument having plucked strings according to claim 10, in which said at least one tone bar prevents said sound board from deforming.

16. A musical instrument having plucked strings according to claim 15, provided with pickups, wherein said at least one tone bar includes a recess through which the pickups pass, in conjunction with reinforcement for mitigating the structural weakening caused by said recess.

* * * * *